US006366028B1

(12) United States Patent
Wener et al.

(10) Patent No.: US 6,366,028 B1
(45) Date of Patent: Apr. 2, 2002

(54) BATTERY POWERED LIGHT

(75) Inventors: James L. Wener; Anthony Kaplan, both of Chicago; Walter Raczynski, Arlington Heights, all of IL (US)

(73) Assignee: CMG Equipment, LLC, Chicago, IL (US)

( * ) Notice: Subject to any disclaimer, the term of this patent is extended or adjusted under 35 U.S.C. 154(b) by 0 days.

(21) Appl. No.: 09/493,551

(22) Filed: Jan. 28, 2000

(51) Int. Cl.[7] ..... H05B 37/00
(52) U.S. Cl. ..... 315/241 P; 362/202
(58) Field of Search ..... 315/241 P, 209 R, 315/225, 224, 242, 307; 362/202, 195, 205, 208, 800

(56) References Cited

U.S. PATENT DOCUMENTS 5,357,419 A * 10/1994 Limpaecher ..... 363/140
5,442,260 A * 8/1995 Saito et al. ..... 315/241 P
5,528,472 A * 6/1996 Maglica et al. ..... 362/202
5,764,501 A * 6/1998 Limpaecher ..... 363/61
5,806,960 A * 9/1998 Chien ..... 362/84
5,869,936 A * 2/1999 Horinishi et al. ..... 315/241 P
5,909,952 A * 6/1999 Guthrie et al. ..... 362/208
5,947,580 A * 9/1999 Chien ..... 362/84
6,074,072 A * 6/2000 Parsons et al. ..... 362/202
6,095,661 A * 8/2000 Lebens et al. ..... 362/208

* cited by examiner

*Primary Examiner*—Don Wong
*Assistant Examiner*—Thuy Vinh Tran
(74) *Attorney, Agent, or Firm*—Marshall, Gerstein & Borun

(57) ABSTRACT

A light, such as a miniature flashlight, includes a housing adapted to hold a battery, a voltage step-up circuit disposed so as to come into electrical contact with the battery when the battery is placed in the housing and an illumination device, such as a light emitting diode (LED), electrically connected to the voltage step-up circuit. The voltage step-up circuit increases the voltage provided by the battery to drive the LED, to thereby enable the flashlight to use a power source, such as a single standard AA battery, which provides a DC voltage below the turn-on threshold voltage of the LED.

35 Claims, 3 Drawing Sheets

BATTERY POWERED LIGHT

FIELD OF THE INVENTION

The present invention relates generally to battery powered lights, such as flashlights and, more particularly, to a light that uses a light emitting diode (LED) powered by a single battery.

DESCRIPTION OF THE RELATED ART

Generally speaking, various types of battery powered lights, such as small or miniature flashlights commonly known as pen-lights, exist. One particularly well-known miniature flashlight is sold under the trade name of Mag Light. Miniature flashlights are typically used in applications where a light-weight flashlight having a relatively small profile is desirable, such as in camping, backpacking, hiking, etc. applications. However, miniature flashlights can also be used in other applications, such as in the home, in cars, in boats, in offices such as in doctors' and dentists' offices, etc.

Some known miniature flashlights, such as the Mag Light, use a single AAA battery (1.5 volts DC) to drive an incandescent bulb. Unfortunately, the incandescent bulbs of such flashlights are usually very intolerant to rough usage and shocks and, therefore, wear out relatively quickly, requiring frequent replacement. Because locating and buying replacement bulbs for these flashlights is often inconvenient, an owner is likely to throw the flashlight away and obtain a new one rather than go through the trouble of finding and purchasing a new bulb. This is wasteful and can be expensive. Moreover, incandescent bulbs use a lot of power, which drains the battery of these flashlights rather quickly. For example, in a flashlight having a single AA battery driving an incandescent bulb, the battery has a use-life of about eight hours. As a result, the battery of these flashlights needs to be replaced fairly often.

To alleviate the problems with incandescent bulbs, some miniature flashlights use a light emitting diode (LED) as a light source. LEDs, which are solid state devices, typically have a long life and are very tolerant to rough usage and shocks. As a result, the LEDs of these flashlights tend not to need replacement. Furthermore, because LEDs typically only draw a minimum amount of current, they are a more efficient source of light than an incandescent bulb. This, in turn, means that a flashlight using an LED as a light source generally has a longer use-life per battery.

Unfortunately, to be turned on, LEDs typically require a power source that provides 2.4 volts or higher. As a result, a single standard AA or AAA battery, which only provides 1.5 volts DC, will not drive an LED in a standard flashlight device. As a result, in the past, LED flashlights have been made using two or more AA or AAA batteries connected in series as a power source. These additional batteries, of course, increase the size and weight of the flashlight over a miniature flashlight that uses only a single battery, which is undesirable. Still further, other LED flashlights use one or more small specialty batteries that provide a higher DC voltage, such as lithium batteries or other miniature watch or camera batteries. While enabling the manufacture of a small and lightweight flashlight able to use an LED as a light source, these specialty batteries are generally much more expensive and are much harder to find and buy than standard batteries, such as AA or AAA batteries. Replacing the batteries in these flashlights becomes much more expensive and difficult because the user has to go to a specialty store like a watch store or a camera store to find these batteries, which is inconvenient.

SUMMARY OF THE INVENTION

A light, such as a miniature flashlight, uses a standard battery, for example, a single AA or AAA battery, to drive a solid state light source, such an LED, even though the DC voltage output of the battery is lower than the turn-on threshold voltage of the solid state device. In one embodiment, a flashlight includes a battery holder electrically connected to a voltage step-up circuit which, in turn, is electrically connected to an LED. The voltage step-up circuit steps up the voltage provided by the battery to a voltage that is above the turn-on threshold of the LED, thereby turning the LED on and causing illumination. The voltage step-up circuit may include an inductor as an energy storage device connected to the LED and to a switch, such as a transistor. In this embodiment, toggling operation of the switch causes the inductor to alternatively store energy and to then discharge energy so that, when discharging energy, the inductor causes the voltage across the LED to be higher than the turn-on threshold voltage of the LED. Thus, in this embodiment, the inductor and switch combination creates an AC voltage across the LED causing the LED to turn on and off at a frequency at which it appears to the user that the LED remains on constantly.

In another embodiment, a light uses a power switching circuit to enable an LED to be driven by a single standard battery which does not provide a DC voltage output large enough to drive the LED unaided. Because the light includes an LED driven by a single battery of a standard size, such as a AA battery, the light can be light-weight and small in size and yet attain the longer life and durability advantages of using an LED as a light source. For example, one embodiment of a flashlight described herein that uses a single AA battery to drive an LED provides a battery life of about 40 hours, as compared to the typical eight hour life for a single AA battery flashlight that uses an incandescent bulb. Still further, the LED of the light described herein can be guaranteed for life because the LED does not burn out easily, as is the case with incandescent bulbs.

DESCRIPTION OF THE PREFERRED EMBODIMENTS

Figure 1:
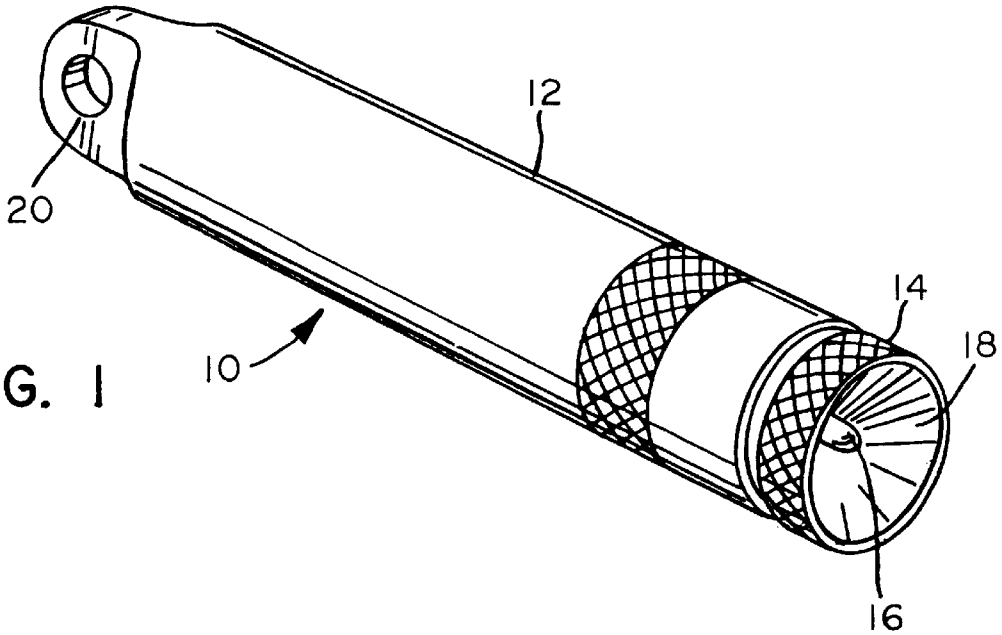
FIG. 1 is a perspective view of a miniature flashlight using a single battery to drive an LED.

Referring now to FIG. 1, a light, illustrated as a miniature flashlight 10 includes a housing 12 which may be made of metal, such as aluminum, and a ferrule 14 which threadably engages the housing 12. The housing 12 operates as a battery storage device which stores, for example, a single battery, such as a single AA battery. Typically, the housing 12 is designed to store a DC battery although other types of batteries may be used, if so desired. As illustrated in FIG. 1, the ferrule 14 includes an LED 16 disposed within a conical reflector 18 as well as a voltage step-up circuit (not shown in FIG. 1). The ferrule 14 can be rotated in one direction with respect to the housing 12 to cause an electrical connection between the battery and the voltage step-up circuit to thereby turn the LED 16 on in the manner described in more detail below. Likewise, the ferrule 14 can be rotated in the other direction to turn the LED 16 off. If desired, the ferrule 14 may be made of metal, such as aluminum, and may have a cross-hatched exterior to provide a better gripping surface for the user, which enables the user to more easily rotate the ferrule 14 with respect to the housing 12.

The housing 12, which may be made of any type of material but which is preferably made of aluminum, such as aircraft aluminum, may be painted, provided with a powder coating or may be anodized. Also, as illustrated in FIG. 1, the housing 12 may include a flange 20 at one end thereof with a hole disposed within the flange 20. This flange/hole combination may be adapted to accept, for example, a key ring, string or other connector to be used to connect the miniature flashlight 10 to other items such as belts, bags, camping equipment, etc.

Figure 2:
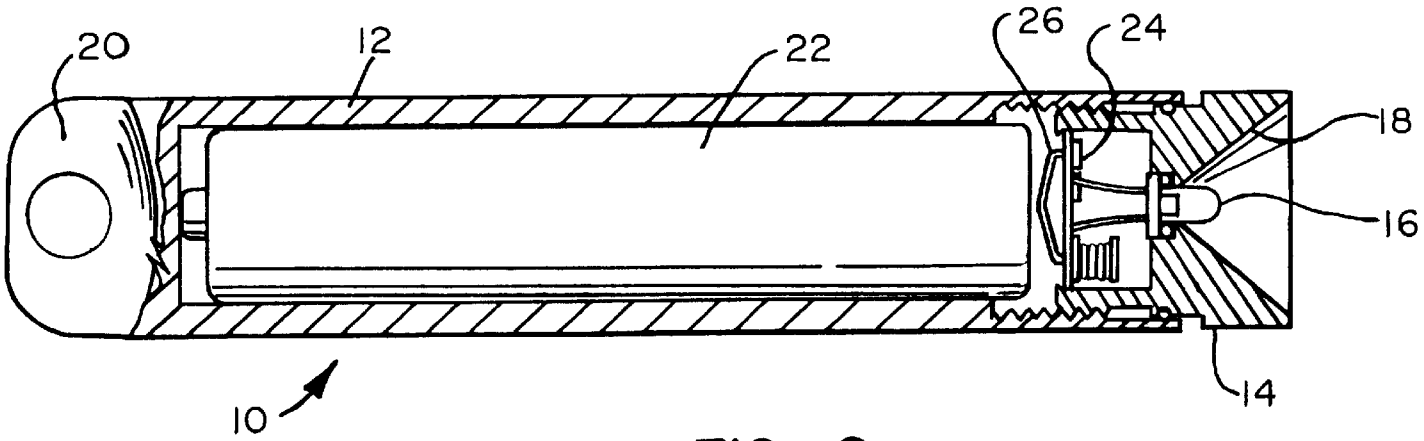
FIG. 2 is a cut away view of the flashlight of FIG. 1.

As illustrated in FIG. 2, a battery 22, which may be any type of battery such as a standard AAA, AA, C-cell, or D-cell battery, to name a few, is disposed within the housing 12. A voltage step-up circuit 24 is disposed within the ferrule 14 on one end of the battery 12. The voltage step-up circuit 24 includes a contact plate 26 that is disposed near the battery 22 and that comes into contact with one terminal (e.g. the negative terminal) of the battery 22 when the ferrule 14 is rotated in one direction within the housing 12. The other end of the battery 22, illustrated in FIG. 2 as the positive terminal of the battery 22, comes into contact with the interior portion of the housing 12 near the flange 20 and is electrically connected through the walls of the housing 12, threads on the housing 12 and threads on the ferrule 14 to the voltage step-up circuit 24. When the ferrule 14 is rotated in, for example, the clockwise direction, the ferrule 14 moves toward the negative terminal of the battery 22 until the contact plate 26 comes into contact with the negative terminal of the battery 22, thereby completing an electrical circuit and turning the LED 16 on. Similarly, when the ferrule 14 is rotated in the opposite direction, the ferrule 14 moves away from the battery 22 until the contact plate 26 loses contact with the battery 22, which opens the electrical circuit and turns the LED 16 off.

Generally, the voltage step-up circuit 24 is a switching circuit that operates to provide an oscillating voltage in the form of a square wave across the terminals of the LED 16, wherein the peak voltage of the square wave is high enough to turn the LED 16 on. In other words, the voltage across the LED 16 is periodically higher than the 1.5 DC volts provided by the battery 22. In this manner, the voltage step-up circuit 24 turns the LED 16 on and off at a high frequency, for example, at 300 KHz or 500 KHz. Because the LED 16 is being turned on and off at such a high frequency, it appears to the user that the LED 16 remains on constantly.

Figure 3:
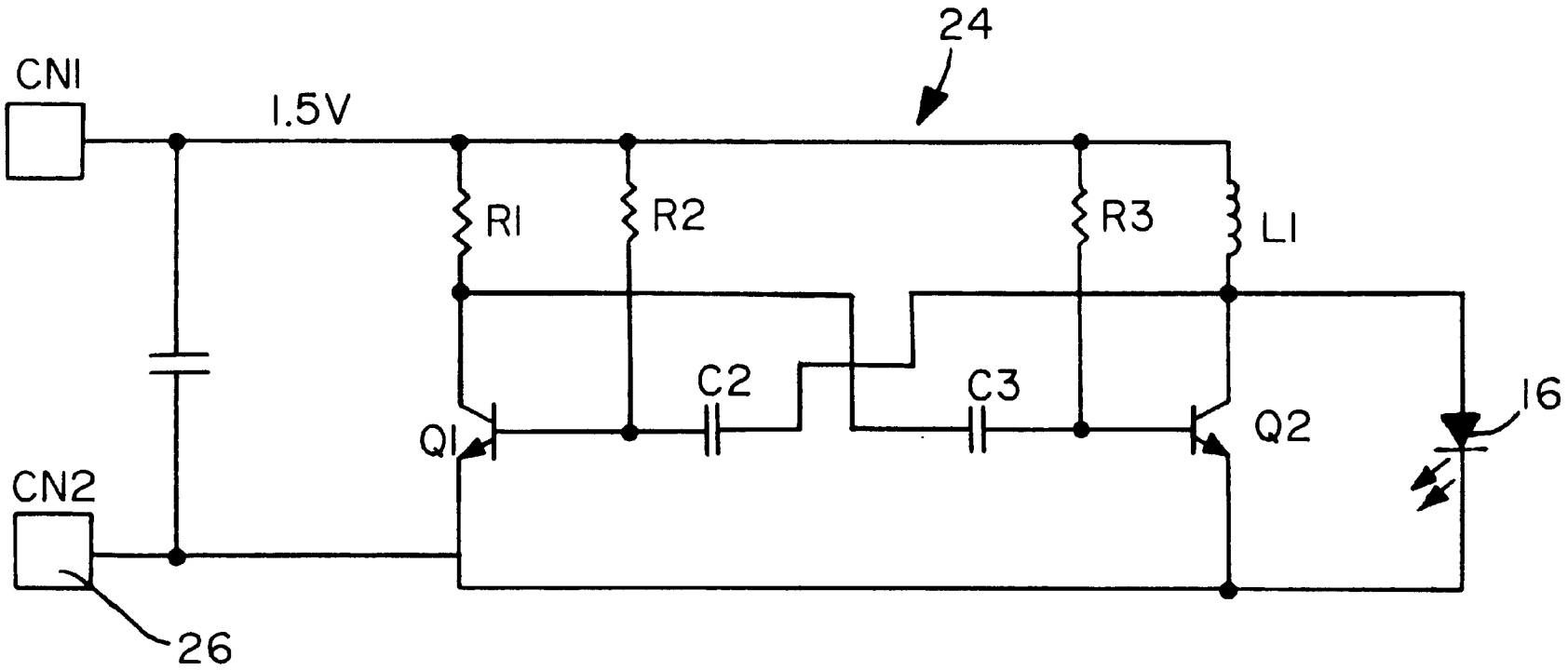
FIG. 3 is a circuit diagram of a voltage step-up circuit used in the flashlight of FIGS. 1 and 2.
Figure 4:
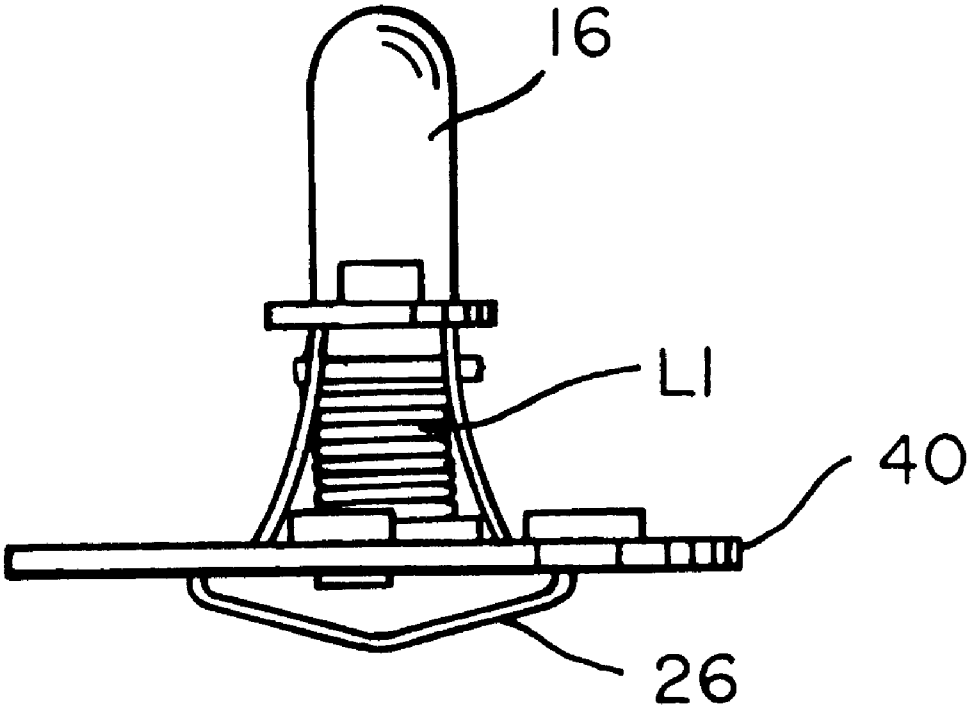
FIG. 4 is a side view of the voltage step-up circuit used in the flashlight of FIGS. 1 and 2.

One embodiment of a voltage step-up circuit 24 is illustrated in schematic form in FIG. 3. FIG. 4 illustrates a side view of one layout of the voltage step-up circuit 24 disposed on a circuit board prior to being inserted into the ferrule 14. Referring first to FIG. 3, a first connector CN1 is connected to the ferrule 14 which, as described with respect to FIG. 2, is electrically connected to the positive terminal of the battery 22 to thereby receive 1.5 volts DC when the connection between both terminals of the battery 22 and the circuit 24 is completed. A second terminal CN2 is connected to the contact plate 26 and is electrically coupled to the negative terminal of the battery 22 when the ferrule 14 is screwed far enough into the housing 12. A capacitor Cl operates as a high pass filter between the terminals CN1 and CN2 to help assure proper operation of the circuit 24. The circuit 24 also includes two transistors Q1 and Q2 which operate as switches.

As illustrated in FIG. 3, the collector of the transistor Q1 is connected to the terminal CN1 via a resistor R1 while the emitter of the transistor Q1 is connected to the terminal CN2. The base of the transistor Q1 is connected to the terminal CN1 via a resistor R2 and to the first terminal of the LED 16 through a capacitor C2. The collector of the transistor Q2 is connected to the terminal CN1 through an inductor LI, is connected directly to the first terminal of the LED 16 and is connected to the capacitor C2, while the emitter of the transistor Q2 is connected directly to the terminal CN2. Likewise, the base of the transistor Q2 is connected to the terminal CN1 through a resistor R3 and is connected to the collector of the transistor Q1 through a capacitor C3. The second terminal of the LED 16 is connected to the terminal CN2.

During operation, that is, when the terminal CN2 is first connected to the negative terminal of the battery 22 and the terminal CN1 is connected to the positive terminal of the battery 22, current flows through the resistor R2, and begins to charge up the capacitor C2. When the capacitor C2 charges up to a value at which the voltage at the base of the transistor Q1 reaches the turn-on voltage of the transistor Q1, typically about 0.5 to 0.6 volts, the transistor Q1 turns on, which effectively connects the collector of the transistor Q1 to ground (i.e., to the terminal CN2). The turning on of the transistor Q1 connects the capacitor C3 to ground which enables the capacitor C3 to begin to charge up through the resistor R3. Meanwhile, the capacitor C2 discharges. When the capacitor C3 charges up enough to allow the voltage at the base of the transistor Q2 to reach the turn-on threshold of the transistor Q2, the transistor Q2 turns on. This effectively connects the collector of the transistor Q2 to ground which, in turn, connects the capacitor C2 to ground causing the transistor Q1 to turn off while the capacitor C2 again begins to charge up through the resistor R2. When the capacitor C2 charges sufficiently, the transistor Q1 turns on again, which connects the capacitor C3 to ground. This, in turn, causes the transistor Q2 to turn off while the capacitor C3 charges up until it has sufficient voltage to turn the transistor Q2 on. The process of the transistors Q1 and Q2 turning on and off in alternating fashion is repeated as long as the terminal CN2 is connected to the battery 22.

Importantly, during the switching operation of the transistors Q1 and Q2, the inductor L1 operates to store and discharge energy in such a manner that the inductor L1 creates an alternating voltage signal across the LED 16, wherein portions of the voltage signal are higher in magnitude than the 1.5 volts DC provided by the battery 22 and are, in fact, high enough to turn the LED 16 on. In particular, when the transistor Q2 is on, current flows through the inductor L1 and the transistor Q2 in an increasing manner. However, when the transistor Q2 turns off, due to the fact that the operation of the inductor L1 is determined by the equation $v=L\,d(i)/d(t)$ (wherein L is the inductance value of the inductor L1, v is the voltage across the inductor L1, i is current through the inductor L1, t is time and d() indicates the derivative function), the voltage v across the inductor L1 spikes up quickly due to the sudden change of current flow through the inductor L1 (i.e., from some maximum value to about zero) in a very short period of time. When the flyback voltage across the inductor L1 added to the 1.5 volts provided by the battery 22 becomes equal to or greater than the threshold turn-on voltage of the LED 16, current starts flowing from the inductor L1 through the LED 16 causing the LED 16 to emit light. When the transistor Q2 opens, the voltage across the LED 16 immediately drops below the threshold voltage of this device and the LED 16 turns off. At this time, current flows through the inductor L1 and the transistor Q2, and the inductor L1 starts to store energy again in the form of current flow.

Generally speaking, the operation of the circuit 24 provides a square wave (or an approximate square wave) voltage across the LED 16 having an oscillation frequency and a duty cycle. Example values for the capacitors, the resistors and the inductor are provided in the tables below, although it will be understood that other values for these components could be used instead to provide an alternating voltage across the LED 16 having different characteristics, such as a different frequency or duty cycle. The circuit of FIG. 3 using the values of Table 1 below generally provides a 500–600 KHz square wave voltage signal having a duty cycle of about 20–25 percent across the LED 16 while the circuit of FIG. 3 using the values of Table 2 below generally provides a 200–300 KHz square wave voltage signal having a duty cycle of about 40 percent across the LED 16. Of course, one skilled in the art will realize that other values for the circuit components in FIG. 3 could be used to, for example, increase or decrease the power dissipated by the LED 16 and, thus, increase or decrease the brightness of the light provided by the miniature flashlight 10.

TABLE 1

| | |
|---|---|
| C1 | 0.1 micro-farad |
| C2 | 330 pico-farad |
| C3 | 1000 pico-farad |
| R1 | 150 ohms |
| R2 | 1.8K-ohms |
| R3 | 560 ohms |
| L1 | 220 micro-henries |

TABLE 2

| | |
|---|---|
| C1 | 0.1 micro-farad |
| C2 | 2200 pico-farad |
| C3 | 2200 pico-farad |
| R1 | 150 ohms |
| R2 | 750 ohms |
| R3 | 560 ohms |
| L1 | 220 micro-henries |

While one kind of voltage step-up circuit 24 is described herein, it will be understood that other types of voltage step-up circuits could be used instead, so long as these circuits provide a voltage across the LED 16 (or other solid state light source) which is high enough to turn the LED 16 on either continuously or in an alternating manner. Thus, the light described herein is not limited to the use of the particular voltage step-up circuit 24 described herein but can use any other desirable voltage step-up circuit, such as any suitable multi-vibrating circuit, self oscillating flyback circuit or any power switching circuit, all of which are well known. Of course, the voltage step-up circuit 24 can provide an AC voltage signal across the LED or, if desired, a DC voltage signal across the LED or other solid state or non-solid state illumination device.

Of course, any desired type of LED could be used including, for example, red, yellow or white light LEDs. As is known, different LEDs have different turn-on or threshold voltages. For example, the turn-on threshold voltage of white light LEDs is usually higher than that of yellow or red light LEDs and this turn-on threshold voltage must be accounted for when designing the voltage step-up circuit 24 to assure that the step-up circuit 24 will create a voltage signal across the LED sufficient to turn the LED on for an adequate amount of time.

Referring now to FIG. 4, one embodiment of the circuit 24 of FIG. 3 is illustrated as being placed on a circular circuit board 40 capable of being inserted into the ferrule 14 of FIG. 2. In particular, the contact plate 26 extends from the bottom of the circuit board 40 to come into contact with the battery 22. While shown as extending down from the circuit board 40, the contact plate 26 could be disposed flat on the bottom of the board 40. The LED 16 is disposed in the center of the board 40 so that the LED 16, which extends up through the center of the reflector 18 is insensitive to rotational placement of the board 40 within the ferrule 14. The resistors, capacitors and transistors, which are generally small in nature, may be disposed on the circuit board 40 in any desired manner. However, as illustrated in FIG. 4, the inductor L1, which is typically the largest component of the circuit 24, may be disposed on the circuit board 40 so that the top of the inductor L1 is below the bottom of the LED 16, it being understood that the LED 16 has leads which connect the LED 16 to the circuit board 40. Of course, any other desired physical layout of the circuit 24 and LED 16 can be used as well and the exact manner in which the components are placed on the circuit board 40 is not considered to be critical. If desired, the circuit board 40 may be held within the ferrule 14 such as by crimping a piece of metal or other material over the top of the board 40 (or on the edge of the board 40) to prevent the board 40 from moving with respect to the threads of the ferrule 14.

It will, of course, be understood that other materials, components and layouts could be used according to the present invention. For example, other types of switches could be used to turn the miniature flashlight 10 on and off and the battery 22 could be disposed in the opposite direction, if so desired, so long as the circuit 24 was designed for this change of polarity. Likewise, while the miniature flashlight 10 has been described herein as using a single AA battery, any other battery could be used as well including AAA batteries, C and D-cell batteries, etc. Still further, if desired, more than one battery could be used as a power source, as long as a voltage step-up circuit 24 is used to provide a sufficient power signal to the LED. Still further, other illumination devices including other types of solid state devices, such as laser diodes, etc., and non-solid state devices could be used instead of the LED as a light source. While a flashlight using a voltage step-up circuit has been described herein as a miniature flashlight, it will be understood that any other type of light can be designed to use such a circuit and still fall within the scope of the claims. Thus, the light described herein need not be a flashlight but could be any other type of light, such as a headlight, a laser pointer or other pointing device, as well as any other type of, for example, portable or handheld light as well as a stationary light.

Thus, while the present invention has been described with reference to specific examples, which are intended to be illustrative only and not to be limiting of the invention, it will be apparent to those of ordinary skill in the art that changes, additions or deletions may be made to the disclosed embodiments without departing from the spirit and scope of the invention.

What is claimed is:

1. A flashlight comprising:

a housing adapted to hold a battery;

a transformerless voltage step-up circuit adapted to be electrically connected to the battery when the battery is disposed within the housing, the voltage step-up circuit providing an output voltage greater than the initial voltage of the battery when the voltage step-up circuit is connected to the battery; and a light source electrically connected to the voltage step-up circuit.

2. The flashlight of claim 1, wherein the light source is a solid state device.

3. The flashlight of claim 1, wherein the light source is a light emitting diode.

4. The flashlight of claim 1, wherein the housing is adapted to hold only a single battery.

5. The flashlight of claim 1, wherein the housing is adapted to hold only a single AA battery.

6. The flashlight of claim 1, wherein the light source is a solid state device having a voltage turn-on threshold and the housing is adapted to hold a DC battery that provides a DC voltage less than the voltage turn-on threshold of the solid state device.

7. The flashlight of claim 1, wherein the light source is a solid state device and wherein the voltage step-up circuit is a switching circuit that creates an alternating voltage signal across the solid state device.

8. The flashlight of claim 7, wherein the voltage step-up circuit creates a voltage that alternates at a frequency greater than or equal to 200 kilohertz.

9. The flashlight of claim 7, wherein the voltage step-up circuit creates a voltage that alternates at a frequency such that the light emitted by the flashlight appears continuous.

10. The flashlight of claim 7, wherein the battery includes a positive battery terminal and a negative battery terminal, and wherein the voltage step-up circuit includes a first terminal adapted to be connected to the positive battery terminal, a second terminal adapted to be connected to the negative battery terminal, and an inductor connected in series with a switch between the first and second terminals such that operation of the switch causes the inductor to alternatively store energy from the battery and to dissipate energy through the solid state device when the positive and negative battery terminals are electrically connected to the first and second terminals.

11. The flashlight of claim 10, wherein the solid state device is a light emitting diode.

12. The flashlight of claim 10, wherein the switch is a transistor.

13. The flashlight of claim 1, wherein the flashlight is a miniature flashlight.

14. The flashlight of claim 1, wherein the voltage step-up circuit includes an inductor that is connected in series with the light source.

15. A light comprising:

a housing adapted to hold a battery;

a voltage step-up circuit adapted to be electrically connected to the battery when the battery is disposed within the housing, the voltage step up circuit providing an output voltage greater than the initial voltage of the battery when the voltage step-up circuit is connected to the battery; and a solid state light source electrically connected to the voltage step-up circuit.

16. The light of claim 15, wherein the light source is a light emitting diode (LED).

17. The light of claim 16, wherein the housing is adapted to hold only a single DC battery.

18. The light of claim 16, wherein the housing is adapted to hold only a single AA sized battery.

19. The light of claim 16, wherein the LED has a voltage turn-on threshold and the housing is adapted to hold a DC battery that provides a DC voltage less than the voltage turn-on threshold of the LED.

20. The light of claim 16, wherein the voltage step-up circuit is a switching circuit adapted to develop an alternating voltage across the LED.

21. The light of claim 20, wherein the voltage step-up circuit creates a voltage across the LED that alternates at a frequency greater than or equal to 200 kilohertz.

22. The light of claim 20, wherein the voltage step-up circuit creates a voltage across the LED that alternates at a frequency such that the light emitted by the LED appears continuous.

23. The light of claim 16, wherein the battery includes a positive battery terminal and a negative battery terminal and wherein the voltage step-up circuit includes a first terminal adapted to be connected to the positive battery terminal, a second terminal adapted to be connected to the negative battery terminal, and an inductor connected in series with a switch between the first and second terminals, wherein operation of the switch causes the inductor to alternatively store energy from the battery and to dissipate energy through the LED when the positive and negative battery terminals are electrically connected to the first and second terminals.

24. The light of claim 23, wherein the switch is a transistor.

25. The light of claim 15, wherein the solid state device is a two terminal device.

26. The light of claim 15, wherein the light is a handheld flashlight.

27. The light of claim 15, wherein the housing is adapted to hold only a single AA sized battery.

28. The light of claim 15, wherein the voltage step-up circuit includes an inductor that is connected in series with the solid state light source.

29. A light comprising:

a housing adapted to hold one or more DC batteries;

a switching circuit coupled to the housing and adapted to be electrically connected to the one or more batteries when the one or more batteries are disposed within the housing; and a solid state light source electrically connected to the switching circuit;

wherein the switching circuit provides an alternating voltage across the solid state light source to alternatively turn the solid state light source on and off in a periodic manner.

30. The light of claim 29, wherein the voltage step-up circuit creates a voltage across the solid state light source that alternates at a frequency greater than or equal to between 200 kilohertz.

31. The light of claim 29, wherein the voltage step-up circuit creates a voltage across the solid state light source that alternates at a frequency such that the light emitted by the solid state light source appears continuous to the user.

32. The light of claim 29, wherein the switching circuit includes an inductor that is connected in series with the solid state light source.

33. The light of claim 29, wherein the switching circuit is a voltage step-up circuit.

34. The light of claim 29, wherein the solid state light source has a voltage turn-on threshold and wherein the one or more DC batteries provide a DC voltage that is less than the voltage turn-on threshold of the solid state light source.

35. The light of claim 34, wherein the solid state light source is a light emitting diode.

* * * * *

US006366028C1

(12) EX PARTE REEXAMINATION CERTIFICATE (6701st)

United States Patent

Wener et al.

(10) Number: US 6,366,028 C1

(45) Certificate Issued: Mar. 17, 2009

(54) BATTERY POWERED LIGHT

(75) Inventors: James L. Wener, Chicago, IL (US); Anthony Kaplan, Chicago, IL (US); Walter Raczynski, Arlington Heights, IL (US)

(73) Assignee: CMG Equipment, LLC, Chicago, IL (US)

Reexamination Request:
No. 90/006,710, Jul. 14, 2003

Reexamination Certificate for:

| | |
|---|---|
| Patent No.: | **6,366,028** |
| Issued: | **Apr. 2, 2002** |
| Appl. No.: | **09/493,551** |
| Filed: | **Jan. 28, 2000** |

(51) Int. Cl.
*H05B 37/00* (2006.01)

(52) U.S. Cl. ..... 315/241 P; 362/202

(58) Field of Classification Search ..... 315/241 P, 315/307, 209 R, 225, 224; 362/202, 205, 362/195, 208, 800; 345/82
See application file for complete search history.

(56) References Cited

U.S. PATENT DOCUMENTS

| | | | | |
|---|---|---|---|---|
| 1,487,983 | A | | 3/1924 | Stiriss |
| 2,105,632 | A | | 1/1938 | Bernesser |
| 2,677,022 | A | | 4/1954 | Fleming |
| 3,835,272 | A | | 9/1974 | Wisenbaker |
| 4,114,187 | A | | 9/1978 | Uke |
| 4,220,985 | A | | 9/1980 | Hukuba |
| 4,290,095 | A | | 9/1981 | Schmidt |
| 4,342,954 | A | | 8/1982 | Griffith |
| 4,577,263 | A | | 3/1986 | Maglica |
| 4,581,686 | A | | 4/1986 | Nelson |
| 4,864,474 | A | * | 9/1989 | Maglica ..... 362/203 |
| 4,866,430 | A | | 9/1989 | Chek |
| 4,905,129 | A | | 2/1990 | Sharrah |
| 5,161,095 | A | | 11/1992 | Gammache |
| 5,167,447 | A | * | 12/1992 | Gonzales ..... 362/202 |
| 5,278,739 | A | | 1/1994 | Gammache |
| 5,418,434 | A | | 5/1995 | Kamens |
| 5,590,951 | A | | 1/1997 | Matthews |
| 5,629,105 | A | | 5/1997 | Matthews |
| 5,642,932 | A | | 7/1997 | Matthews |
| 5,646,484 | A | | 7/1997 | Sharma |
| 5,671,999 | A | | 9/1997 | Guthrie et al. |
| 6,046,572 | A | | 4/2000 | Matthews et al. |
| 6,222,138 | B1 | | 4/2001 | Matthews et al. |
| 6,246,184 | B1 | | 6/2001 | Salerno |
| 6,296,367 | B1 | | 10/2001 | Parsons |
| 6,320,330 | B1 | | 11/2001 | Haavisto |

OTHER PUBLICATIONS

Don Lancaster, "A New Cave Lamp," Tech Musings, May 1998, pp. 124–.2–124.3.
Affidavit signed by Cornell H. Baxter—Dec. 7, 2002.
Affidavit signed by Stephen Fleming—Dec. 7, 2002.
Affidavit signed by Esty R. Pape,—date unknown.
Affidavit signed by David S. Belski—Dec. 7, 2002.
Affidavit signed by Carl Pagaino—Dec. 7, 2002.
Affidavit signed by Blake N. Jordan—Dec. 7, 2002.
Affidavit signed by Robert B. Pape—Dec. 7, 2002.
Affidavit signed by Glenda Dawson—Dec. 7, 2002.
Affidavit signed by Robert E. Cornish—Dec. 7, 2002.
Affidavit signed by Kathy Peerman—Dec. 7, 2002.

(Continued)

*Primary Examiner*—David Vu

(57) ABSTRACT

A light, such as a miniature flashlight, includes a housing adapted to hold a battery, a voltage step-up circuit disposed so as to come into electrical contact with the battery when the battery is placed in the housing and an illumination device, such as a light emitting diode (LED), electrically connected to the voltage step-up circuit. The voltage step-up circuit increases the voltage provided by the battery to drive the LED, to thereby enable the flashlight to use a power source, such as a single standard AA battery, which provides a DC voltage below the turn-on threshold voltage of the LED.

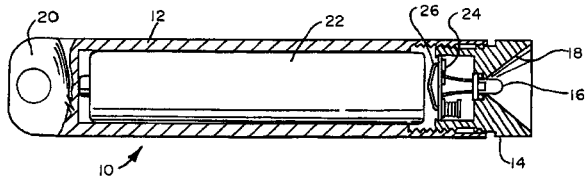

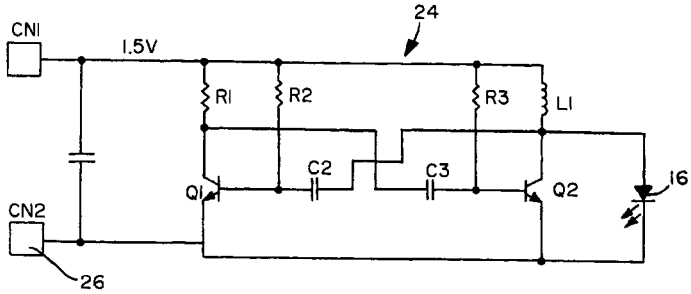

OTHER PUBLICATIONS

Affidavit signed by Stephen Peerman—Dec. 7, 2002.
Affidavit signed by Linda Starr—Dec. 7, 2002.
Affidavit signed by Carol Belski—Dec. 7, 2002.
Affidavit signed by John S. McLean—Dec. 7, 2002.
"Glow–Bug.Com Flashlights, LEDs & Cool Gifts," Glow–Bug.com, available at http://www.glow–bug.com/product.php?sku=63 on Aug. 26, 2002.
"Review: Starlite and Arc–AAA LED flashlights," Dan's Data available at http://www.dansdata.com/ledlights4.htm on Aug. 26, 2002.
"Flashlight Information," Arc Flashlight available at http://store.yahoo.com/flashlight/flasin.html on Aug. 26, 2002.
"Technology," Arc Flashlight available at http://store.yahoo.com/flashlight/technology.html on Aug. 26, 2002.
"Testimonials," Arc Flashlight available at http://store.yahoo.com/flashlight/testimonials.html on Aug. 26, 2002.
"Reviews," Arc Flashlight available at http://store.yahoo.com/flashlight/reviews.html on Aug. 26, 2002.
"FAQ," Arc Flashlight available at http://store.yahoo.com/flashlight/faq.html on Aug. 26, 2002.

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2 and 4 are cancelled.

Claims 1, 10 and 15–35 are determined to be patentable as amended.

Claims 3, 5–9 and 11–14, dependent on an amended claim, are determined to be patentable.

New claims 36 and 37 are added and determined to be patentable.

1. A flashlight comprising:

a *flashlight* housing [adapted] *configured* to hold *only* a *single* battery*, the housing comprising a first portion configured to hold the single battery, a second portion threadably engaging the first portion of the housing and an interior portion electrically connected to a first terminal of the battery when the battery is disposed within the first portion of the housing*;

a transformerless voltage step-up circuit [adapted to be] *disposed within the housing and having a contact plate* electrically connected to *a second terminal of* the battery when the battery is disposed within the *first portion of the* housing *and the second portion of the housing is rotated in a first direction within the first portion of the housing, the transformerless voltage step-up circuit further including an input terminal electrically coupled to the first terminal of the battery via the interior portion of the housing and the second portion of the housing when the second portion of the housing is rotated in the first direction*, the voltage step-up circuit providing an output voltage greater than the initial voltage of the battery when the voltage step-up circuit is connected to the battery; and a *solid state* light source electrically connected to the voltage step-up circuit.

10. The flashlight of claim 7, wherein the *first terminal of the* battery [includes] *is* a positive battery terminal and *the second terminal of the battery is* a negative battery terminal, and wherein the *input terminal of the* voltage step-up circuit [includes a first terminal] *is* adapted to be connected to the positive battery terminal, [a second terminal] *the contact plate is* adapted to be connected to the negative battery terminal, and *the voltage step-up circuit includes* an inductor connected in series with a switch between the [first and second terminals] *input terminal and the contact plate* such that operation of the switch causes the inductor to alternatively store energy from the battery and to dissipate energy through the solid state device when the positive and negative battery terminals are electrically connected to the [first and second terminals] *input terminal and the contact plate*.

15. A [light] *flashlight* comprising:

a *flashlight* housing adapted to hold a *single* battery*, the housing having an interior portion configured to be electrically connected to a first terminal of a battery when the battery is disposed within the housing*;

*a ferrule configured to threadably engage the housing;* a voltage step-up circuit *disposed within the ferrule and having a contact plate* adapted to be electrically connected to *a second terminal of* the battery when the battery is disposed within the housing *and the ferrule is rotated in a first direction within the housing, the voltage step-up circuit further including an input terminal configured to be electrically coupled to the first terminal of the battery via the ferrule and the interior portion of the housing*, the voltage step up circuit providing an output voltage greater then the initial voltage of the battery when the voltage step-up circuit is connected to the battery; and a solid state light source electrically connected to the voltage step-up circuit.

16. The [light] *flashlight* of claim 15, wherein the light source is a light emitting diode (LED).

17. The [light] *flashlight* of claim 16, wherein the housing is adapted to hold only a single DC battery.

18. The [light] *flashlight* of claim 16, wherein the housing is adapted to hold only a single AA sized battery.

19. The [light] *flashlight* of claim 16, wherein the LED has a voltage turn-on threshold and the housing is adapted to hold a DC battery that provides a DC voltage less than the voltage turn-on threshold of the LED.

20. The [light] *flashlight* of claim 16, wherein the voltage step-up circuit is a switching circuit adapted to develop an alternating voltage across the LED.

21. The [light] *flashlight* of claim 20, wherein the voltage step-up circuit creates a voltage across the LED that alternates at a frequency greater than or equal to 200 kilohertz.

22. The [light] *flashlight* of claim 20, wherein the voltage step-up circuit creates a voltage across the LED that alternates at a frequency such that the light emitted by the LED appears continuous.

23. The [light] *flashlight* of claim 16, wherein the *first terminal of the* battery [includes] *is* a positive battery terminal and *the second terminal of the battery is* a negative battery terminal and wherein the *input terminal of the* voltage step-up circuit [includes a first terminal] *is* adapted to be connected to the positive terminal, [a second terminal] *the contact plate is* adapted to be connected to the negative battery terminal, and *the voltage step-up circuit includes* an inductor connected in series with a switch between the [first and second terminals] *input terminal and the contact plate*, wherein operation of the switch causes the inductor to alternatively store energy from the battery and to dissipate energy through the LED when the positive and negative battery terminals are electrically connected to the [first and second terminals] *input terminal and the contact plate*.

24. The [light] *flashlight* of claim 23, wherein the switch is a transistor.

25. The [light] *flashlight* of claim 15, wherein the solid state device is a two terminal device.

26. The [light] *flashlight* of claim 15, wherein the light is a handheld flashlight.

27. The [light] *flashlight* of claim 15, wherein the housing is adapted to hold only a single AA sized battery.

28. The [light] *flashlight* of claim 15, wherein the voltage step-up circuit includes an inductor that is connected in series with the solid state light source.

29. The [light] *flashlight* comprising:

a *flashlight* housing adapted to hold [one or more] *a single* DC [batteries] *battery*;

a switching circuit coupled to the housing and adapted to be electrically connected to the [one or more batteries] *single battery* when the [one or more batteries are] *single battery is* disposed within the housing, *the switching circuit including only two terminals, an input terminal configured to be electrically coupled to a first terminal of the battery through the housing when the battery is disposed within the housing and a contact plate configured to be directly electrically connected to a second terminal of the battery when the battery is disposd within the housing*; and a solid state light source electrically connected to the switching circuit;

wherein the switching circuit provides an alternating voltage across the solid state light source to alternatively turn the solid state light source on and off in a periodic manner.

30. The [light] *flashlight* of claim 29, wherein the [voltage step-up] *switching* circuit creates a voltage across the solid state light source that alternates at a frequency greater than or equal to between 200 kilohertz.

31. The [light] *flashlight* of claim 29, wherein the [voltage step-up] *switching* circuit creates a voltage across the solid state light source that alternates at a frequency such that the light emitted by the solid state light source appears continuous to the user.

32. The [light] *flashlight* of claim 29, wherein the switching circuit includes an inductor that is connected in series with the solid state light source *between the input terminal and the contact plate*.

33. The [light] *flashlight* of claim 29, wherein the switching circuit is a voltage step-up circuit.

34. The [light] *flashlight* of claim 29, wherein the solid state light source has a voltage turn-on threshold and wherein the [one or more] *single* DC [batteries provide] *battery provides* a DC voltage that is less than the voltage turn-on threshold of the solid state light source.

35. The [light] *flashlight* of claim 34, wherein the solid state light source is a light emitting diode.

*36. The flashlight of claim 15, wherein when the ferule is rotated in a second direction within the housing, the contact plate is disposed near the second terminal of the battery when the battery is disposed within the housing.*

*37. The flashlight of claim 29, wherein the first terminal of the battery is a positive terminal and the second terminal of the battery is a negative terminal.*

* * * * *